US007188653B2

(12) United States Patent
Doujak

(10) Patent No.: US 7,188,653 B2
(45) Date of Patent: Mar. 13, 2007

(54) STEEL CORD AND METHOD FOR PRODUCING A STEEL CORD

(75) Inventor: Siegfried Doujak, Hausbach (DE)

(73) Assignee: Drahtcord Saar GmbH & Co., KG, Merzig (DE)

( * ) Notice: Subject to any disclaimer, the term of this patent is extended or adjusted under 35 U.S.C. 154(b) by 103 days.

(21) Appl. No.: 10/398,367

(22) PCT Filed: Oct. 11, 2001

(86) PCT No.: PCT/EO01/11795

§ 371 (c)(1),
(2), (4) Date: Sep. 5, 2003

(87) PCT Pub. No.: WO02/31257

PCT Pub. Date: Apr. 18, 2002

(65) Prior Publication Data

US 2005/0098253 A1 May 12, 2005

(30) Foreign Application Priority Data

Oct. 12, 2000 (EP) ..... 00122184

(51) Int. Cl.
*D02G 3/00* (2006.01)
*D02G 3/48* (2006.01)

(52) U.S. Cl. ..... 152/451; 57/243; 57/250; 57/258; 428/357; 428/544

(58) Field of Classification Search ..... None
See application file for complete search history.

(56) References Cited

U.S. PATENT DOCUMENTS 2,464,186 A * 3/1949 Ross ..... 219/145.32
2,905,919 A * 9/1959 Lorch ..... 338/224
3,018,610 A 1/1962 Kleinekathöfer
3,252,569 A * 5/1966 Matthews ..... 206/345
4,420,534 A * 12/1983 Matsui et al. ..... 428/372
4,606,392 A 8/1986 Weidenhaupt et al.
5,188,894 A * 2/1993 Yamada et al. ..... 428/370
6,306,499 B1 * 10/2001 Ochi et al. ..... 428/364

(Continued)

FOREIGN PATENT DOCUMENTS

DE 19709884 * 9/1998

(Continued)

*Primary Examiner*—Justin R. Fischer
(74) *Attorney, Agent, or Firm*—Finnegan, Henderson, Farabow, Garrett & Dunner, L.L.P.

(57) ABSTRACT

A first aspect of the present invention relates to a filament (11; 12), especially for reinforcing rubber articles. Said filament (11; 12) features a contact surface (14) and an outer surface (13). In a second aspect, the invention relates to a steel cord (10) comprising two of said filaments (11, 12), the contact surfaces (14) are arranged adjacent to each other. The outer surfaces (13) are configured arcuate shaped and provide a smooth outer contour (15) of the steel cord (10). Due to said construction the largest dimension (d) of the steel cord (10) and the thickness of a rubber coating (18) may be considerably reduced. Additionally the invention relates to a method of producing a steel cord (10) and to a tyre (20) comprising a carcass ply (22) and/or at least one belt (25; 26) including said steel cords (10).

11 Claims, 4 Drawing Sheets

U.S. PATENT DOCUMENTS 6,465,094 B1 * 10/2002 Dugan ..... 428/370

FOREIGN PATENT DOCUMENTS

| | | | |
|---|---|---|---|
| EP | 0 502 729 A1 | | 9/1992 |
| EP | 1118397 | * | 7/2001 |
| GB | 1424672 | * | 2/1976 |
| JP | 63-085190 | | 4/1988 |
| JP | 2-229288 | * | 9/1990 |
| JP | 3-213402 | * | 9/1991 |
| JP | 05124402 | * | 5/1993 |

* cited by examiner

STEEL CORD AND METHOD FOR PRODUCING A STEEL CORD

In its first aspect the present invention relates to a filament, especially for reinforcing rubber articles. A second aspect of the present invention relates to a steel cord, especially for reinforcing rubber articles, comprising two filaments combined in parallel in order to form said steel cord.

A third aspect of the present invention relates to a method of producing said steel cord.

In a further aspect, the present invention relates to a pneumatic tyre comprising a tread member, a carcass, two side walls and at least one belt.

A steel cord of the above mentioned kind is known from U.S. Pat. No. 4,606,392 and used for reinforcing vehicle tyres. Said known steel cord comprises several metal wires having each a substantially rectangular cross-section defining opposite broad and narrow sides. The metal wires in the steel cord contact one another along their broad sides to provide a strand of a substantially rectangular cross-section. Other known steel cords comprise two circular filaments with a diameter of around 0.30 mm. Usually, the steel cord is provided with a rubber coating prior to embedding in the material of a tyre. The known steel cord features a rather rough, uneven outer surface. Consequently, the thickness of the rubber coating applied must be at least 0.4 mm higher than the largest dimension of the steel cords. For example a steel cord comprising two filaments with a diameter of 0.30 mm will require a rubber coating with a thickness of 1.10 mm. Accordingly, the known steel cord requires a rather thick coating and is quite heavy.

Therefore it is an object of the invention to provide a filament and a steel cord allowing a reduction in rubber coating thickness. It is another object of the invention to provide a method of producing such a steel cord. A fourth object of the invention is to enhance tyre properties by using relatively small and lightweight steel cords.

Said object is achieved by a filament featuring a contact surface and an arcuate shaped outer surface.

In its second aspect the invention relates to a steel cord as mentioned above which is characterized by the use of filaments in accordance with the invention and in that the contact surfaces of said two filaments are arranged adjacent to each other in order to provide a smooth outer contour of said steel cord.

Additionally the invention relates to a method of producing a steel cord comprising two filaments, each of said filaments featuring a contact surface and an arcuate outer surface, wherein the contact surfaces of said two filaments are arranged adjacent to each other, which is characterized in that said two filaments are pre-shaped and subsequently combined in order to form said steel cord.

The fourth aspect of the invention relates to a pneumatic tyre as set forth above which is characterized in that said carcass and/or said at least one belt includes a steel cord in accordance with the second aspect of the present invention.

The cross-section of the filaments with a contact surface and an arcuate shaped outer surface and the arrangement of the contact surfaces adjacent to each other provide a smooth outer contour of the steel cord. Therefore, the largest dimension of the steel cord may be reduced so that the thickness of the rubber coating may be reduced, too. Reduction of rubber coating thickness leads to a number of advantages. First, the expenses for coating are significantly reduced. Second, the steel cord may be arranged closer to each other, e.g. in the carcass ply or belt of a tyre. Therefore, the weight, stiffness and handling of the tyre may be improved compared to the prior art steel cords.

It is preferred to pre-shape the filaments and combine them subsequently. The filaments may be independently pre-shaped from each other. It is possible to obtain any desired form for the contact surface and the outer surface. Additionally, configuration of both the contact surface and the outer surface may be easily assessed. Combining the pre-shaped filaments is to advantage effected with a double twister as disclosed in EP 396 068 B1 issued to the applicant of the present application. Disclosure of EP 396 068 B1 shall be incorporated by reference.

Advantageous embodiments of the invention read from the dependent claims.

To advantage the contact surface is configured flat or slightly curved. The ideal form of the contact surface is a perfect plane. However, slight deviations from said ideal form are not detrimental.

The outer surface may be configured semi-circular or semi-elliptical. As alternative, it may be configured polygonal. With said aspect the outer surface to advantage comprises more than three sides. In order to minimize the maximum dimension of the steel cord, a semi-circular outer surface is used. However, even with a semi-elliptical or polygonal outer surface of the filament the steel cord in accordance with the invention still features a smooth outer contour and a reduced maximum dimension. Again, rubber coating thickness may be considerably reduced.

According to a further aspect of the invention the transition between the contact surface and the outer surface features a radius. None of the filaments is provided with sharp edges which may damage the rubber coating during use. Accordingly, the life time of the steel cord provided with their rubber coating is increased.

To advantage the steel cord features a gap between the contact surfaces of said two filaments. Said gap may be penetrated by the rubber coating in order to avoid corrosion. Moreover, direct contact between the filaments which is likely to damage a protective coating of the filaments is avoided.

To advantage the two filaments feature the same cross-section. It will not be necessary to manufacture and stock different filaments in order to produce the steel cord in accordance with the invention. Additionally, both filaments exhibit the same physical properties.

In accordance with another embodiment the two filaments may feature different cross-sections. One filament may be configured semi-circular while the other one is configured semi-elliptical. It is possible to create a huge variety of different steel cords which are suited for a number of different applications.

It is preferred if the tyre in accordance with the invention comprises two belts which are arranged between the tread member and the carcass. To advantage, the tyre features are radial-ply concept. The use of two belts provides higher safety and reliability, while the radial-ply concept enhances the properties of the tyre.

The invention will now be detailed by way of example embodiments illustrated schematically in the drawings. Like reference signs have been used for parts identical or identical in function.

Figure 1:
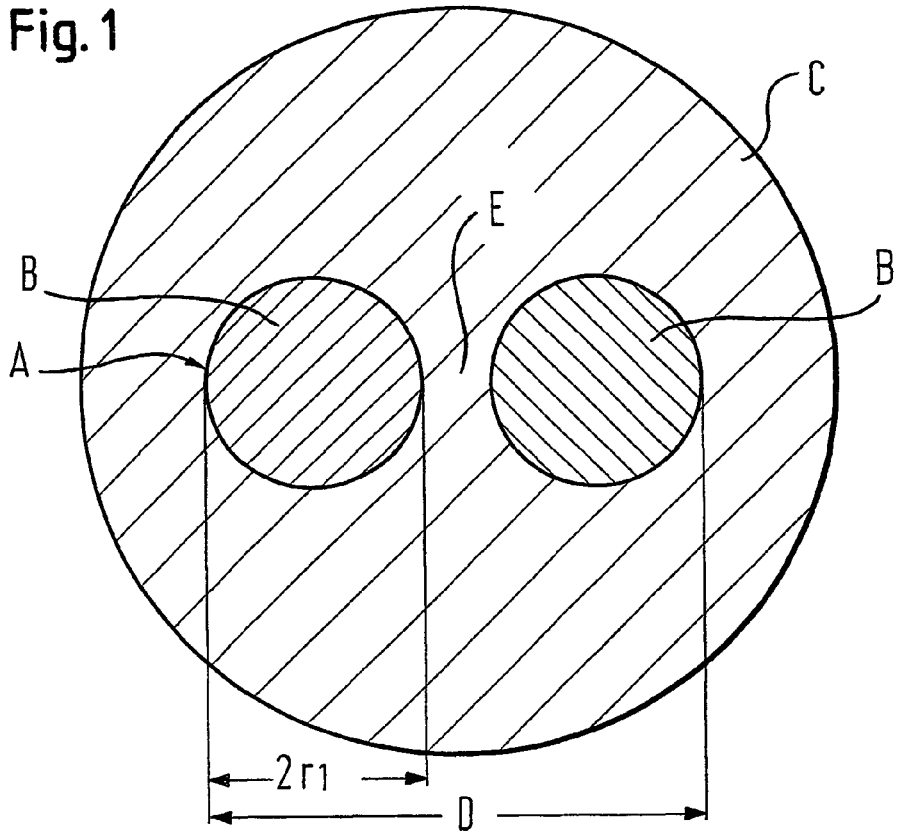
FIG. 1 shows a cross-section of a prior art steel cord provided with a coating.

FIG. 1 shows a cross-section of a prior art steel cord A with two circular filaments B separated by a gap E. The steel cord A is provided with a coating C. The largest dimension of said steel cord A is indicated at D. The thickness of said coating C is determined by said largest dimension D. In FIG. 1, the steel cord A is shown enlarged with a scale of approximately 10:1, the filaments B having a diameter of 0.30 mm (a radius of 0.15 mm) and the coating C having a thickness of 1.10 mm. It is obvious that said coating C is unnecessarily thick at the upper and lower side as shown in FIG. 1.

Figure 2:
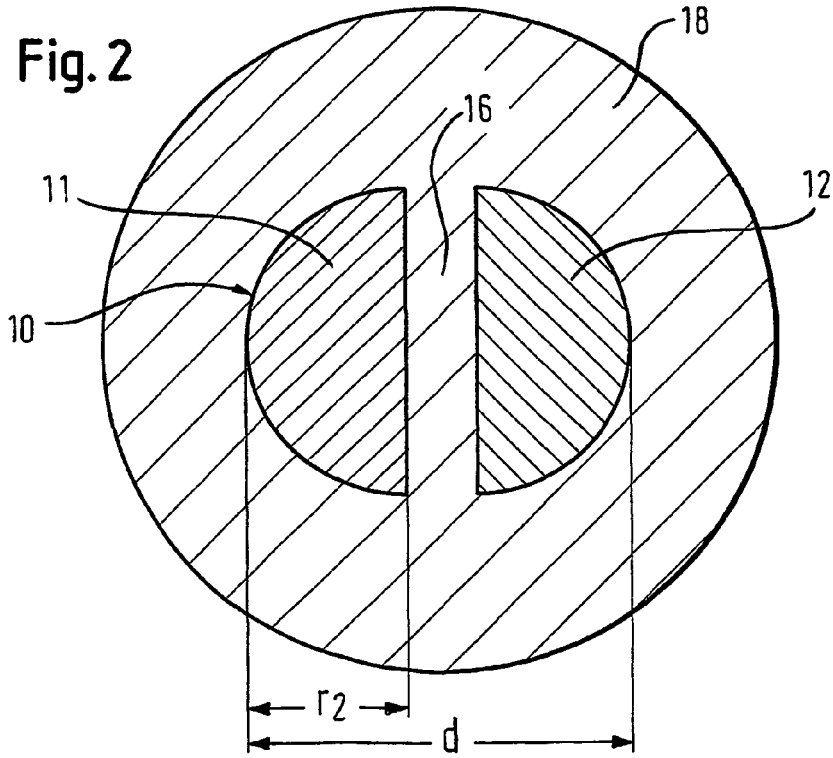
FIG. 2 shows a cross-section of a steel cord in accordance with the invention provided with a coating.

FIG. 2 shows a cross-section of a steel cord 10 in accordance with the invention. Said steel cord 10 comprises two filaments 11, 12 which are approximately semi-circular and is provided with a coating 18. The filaments 11, 12 are separated by a gap 16. The cross-sectional area of said filaments 11, 12 is identical to that of the prior art filaments B. The largest dimension is indicated at d. Again, the steel cord 10 is shown enlarged with scale of 10:1. A comparision of FIGS. 1 and 2 clearly shows that the steel cord 10 in accordance with the invention features a reduced largest dimension d. Accordingly, thickness of the coating 18 may be reduced.

In both the prior art steel cord A and in the steel cord 10 in accordance with the invention the gap E or 16, respectively, is filled with the coating. Direct contact between the filaments and corrosion thereof is avoided.

In the embodiment shown, the filaments 11, 12 are semi-circular. Their respective radius may be calculated as follows:

Cross-sectional area of prior art filaments B (radius $r_1$):

$$A=r_1^2*\pi$$

Cross-sectional area of filaments 11, 12 (radius $r_2$):

$$A=\frac{1}{2}r_2^2*\pi$$

The calculated cross-sectional areas shall be identical:

$$\frac{1}{2}r_2^2*\pi=r_1^2*\pi$$

$$\Rightarrow r_2=\sqrt{2}\,r_1\approx 1,41*r_1$$

Largest dimension D of prior art steel cord A:

$$D=4*r_1+\text{gap}$$

Largest dimension d of steel cord 10 in accordance with the invention:

$$d=2*r_2+\text{gap}=2*\sqrt{2}*r_1+\text{gap}\approx 2.82*r_1+\text{gap}$$

The gap E is approximately equal to the gap 16. Therefore, the change Δ in the largest dimension d or D, respectively, amounts to:

$$\Delta=D-d\approx 1.18*r_1$$

The absolute change Δ with $r_1$=0.15 mm equals to 0.177 mm. The relative change Δ/D equals to 0.1609 or a reduction of about 16%. Accordingly, the thickness of the coating may be reduced, too.

The prior art coating thickness T amounts to $$T=D+0.4\text{ mm}=4*r_1+\text{gap}+0.4\text{ mm}\approx 1.10\text{ mm}$$

while the coating thickness t in accordance with the invention is $$t=d+0.4\text{ mm}=2.82*r_1+\text{gap}+0.4\text{ mm}\approx 0.823\text{ mm}$$

Cross-sectional area $A_1$ of prior art coating C:

$$A_1=\frac{1}{4}T^2*\pi\approx 0.325*\pi\approx 0.9503\text{ mm}^2$$

Cross-sectional area $A_2$ of coating 18 in accordance with the invention:

$$A_2=\frac{1}{4}t^2*\pi\approx 0.169*\pi\approx 0.5320\text{ mm}^2$$

Reduction Δ of cross-sectional area:

$$\Delta=A_1-A_2=0.4183\text{ mm}^2$$

Reduction Δ% of cross-sectional area in percent:

$$\Delta\%=(A_1-A_2)/A_1\approx 44.\%$$

Accordingly, the steel cord 10 in accordance with the invention allows for a significant reduction in coating thickness.

FIGS. 3 to 11 show cross-sections of nine different embodiments of a steel cord 10 in accordance with the invention. As already shown in FIG. 2, the steel cord 10 comprises two filaments 11, 12, each featuring an outer surface 13 and a contact surface 14. The contact surfaces 14 are arranged adjacent to each other so that the outer surfaces 13 provide a smooth outer contour 15 of the steel cord 10. The contact surfaces 14 are separated by the gap 16.

Figure 3:
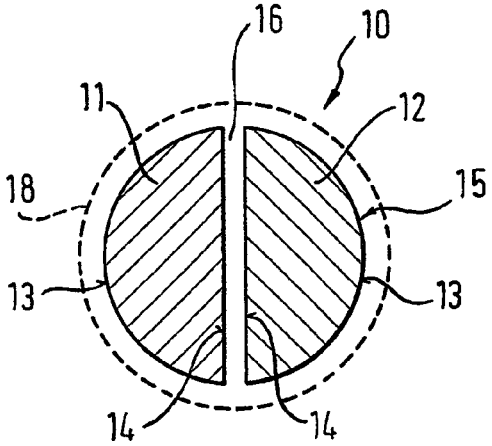
FIG. 3 to FIG. 11 show a cross-section of nine different embodiments of a steel cord in accordance with the invention.
Figure 4:
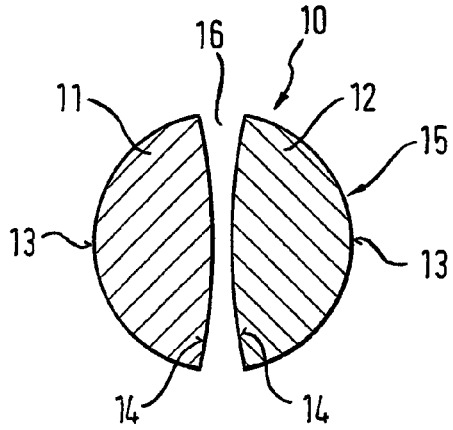

FIGS. 3 and 4 show a steel cord 10 comprising two substantially semi-circular filaments 11, 12. In the embodiment shown in FIG. 3, the contact surfaces 14 are configured flat. FIG. 4 shows filaments 11, 12 with contact surfaces 14 which are slightly curved. It should be noted that curvature of the contact surfaces 14 is exaggerated in the figures for better understanding.

Figure 5:
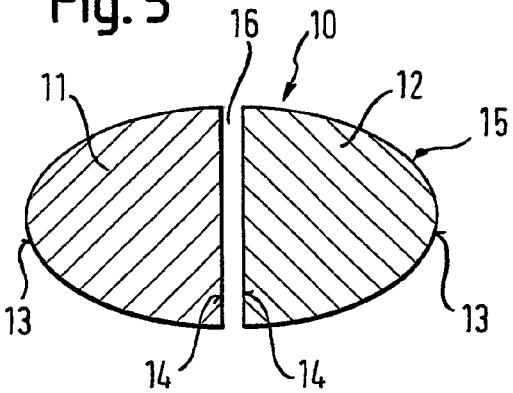
Figure 6:
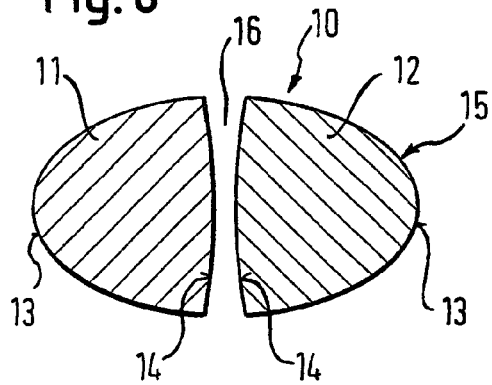

FIGS. 5 and 6 show a steel cord comprising filaments 11, 12 which are configured semi-elliptical. Again, the contact surfaces 14 may be flat or slightly curved.

Figure 7:
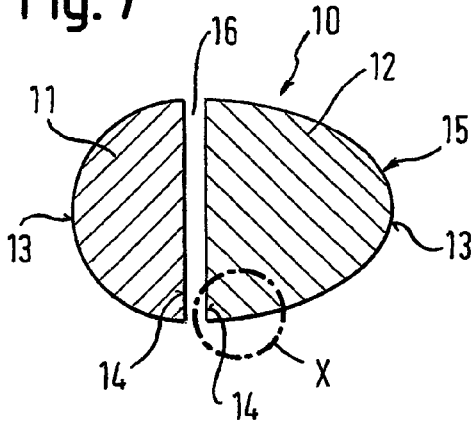
Figure 8:
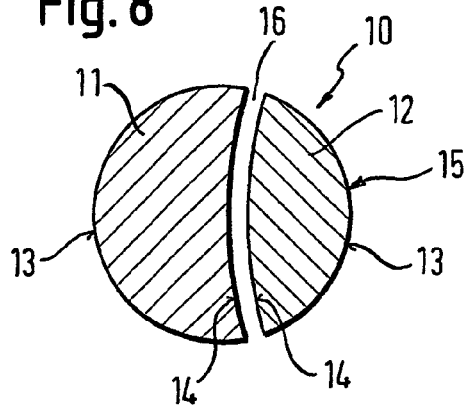

FIGS. 3 to 6 show different embodiments of a steel cord 10 the filaments 11, 12 of which feature the same cross-sectional area and cross-section. It is, however, possible to combine filaments 11, 12 of different cross-sections and cross-sectional areas as shown in FIGS. 7 and 8. FIG. 7 depicts schematically a semi-circular filament 11 together with a semi-elliptical filament 12. FIG. 8 shows a filament 11 configured slightly bigger than a semi-circle. Corresponding filament 12, accordingly, is configured smaller than a semi-circle. The gap 16 is formed by curved contact surfaces 14 arranged in parallel.

In all embodiments shown the outer surface 13 is configured arcuate, especially semi-circular or semi-elliptical. It is possible to use a polygonal outer surface 13, too. It is, however, important that the outer contour 15 formed by the two outer surfaces 13 be smooth.

Figure 9:
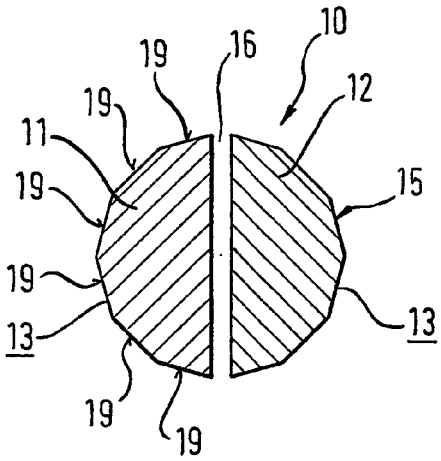
Figure 10:
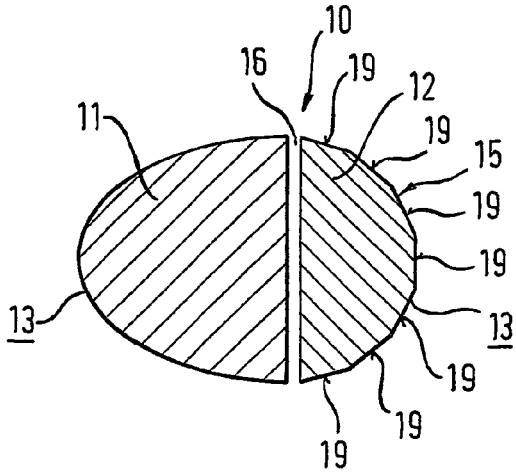
Figure 11:
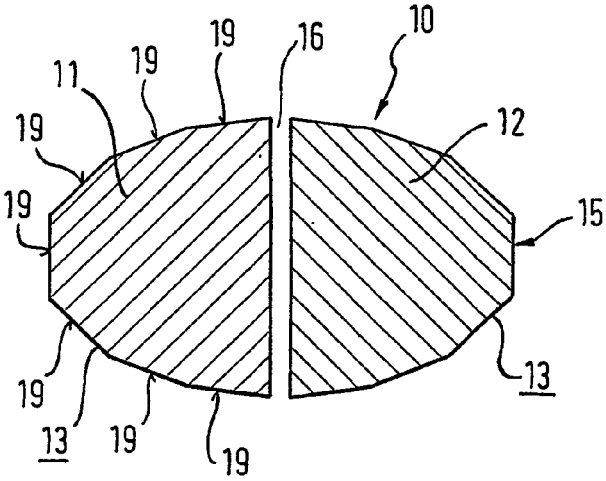

FIGS. 9 to 11 show steel cords 10 comprising one or two filaments 11, 12 with a polygonal outer surface 13. Said steel cords 10 do still feature a smooth outer contour 15. FIG. 9 shows an embodiment with two filaments 11, 12 featuring the same cross-section. The outer contour comprises six sides 19.

FIG. 10 shows a combination of a semi-elliptical filament 11 and a polygonal filament 12. The outer contour 13 of filament 12 comprises seven sides. FIG. 11 shows two filaments 11, 12 which are basically semi-elliptical, but provided with a polygonal outer surface 13. Both filaments 11, 12 feature seven sides.

It is important that the outer surface 13 of filaments 11, 12 features at least three sides. Otherwise, the steel cord 10 would feature a nearly rectangular outer contour 15 which would not allow the desired reduction in rubber coating thickness.

Figure 12:
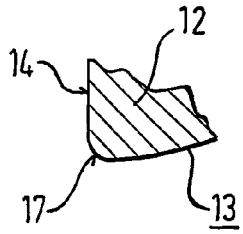
FIG. 12 shows an enlarged view of detail X in FIG. 7.

FIG. 12 shows an enlarged view of detail X in FIG. 7. The transition between the contact surface 14 and the outer surface 13 features a radius 17. Said radius 17 ensures that no sharp edges are present which might damage the rubber coating during use.

Preferably, the above described filaments are wound together according to a winding pitch comprised between 5 mm and 30 mm.

Figure 13:
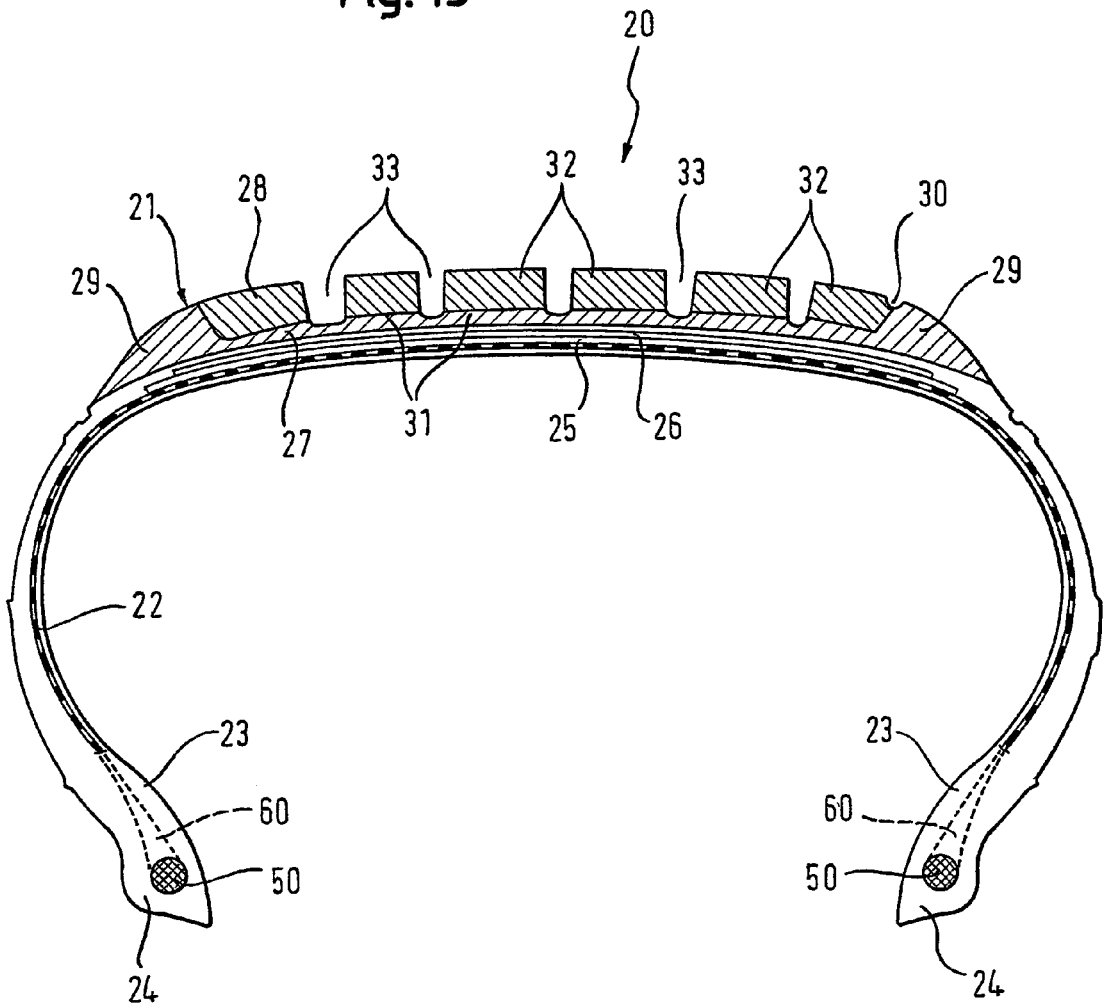
FIG. 13 shows a partial cross-section of a tyre.

FIG. 13 shows a partial cross-section of a tyre 20 comprising a tread member 21, at least a carcass ply 22 and two side walls 23 provided with beads 24 to which the extremities of the carcass ply are associated. Each bead portion 24 comprises a reinforcing bead core 50 provided, in a radially external position, with a filler 60. Arranged between the tread member 21 and the carcass ply 22 are at least two belts 25, 26. Said belts 25, 26 comprise steel cords 10 as described above, parallel to each other in each belt and crossed with the cords of the adjacent belt.

In the embodiment shown, the tread member 21 comprises a base 27 and a cap 28, the base 27 being provided with shoulders 29 extending up to the tread member surface. Arranged between the right-hand shoulder 29 and the cap 28 is a groove 30.

Profile blocks 31, 32 of the base 27 and the cap 28 are obtained by grooves 33.

Due to the reduction of the largest dimension of the steel cords 10 the thickness of their rubber coating 18 may be reduced. Therefore, the steel cords 10 may be arranged closer to each other in the belts 25, 26. At the same time, the radial dimension of belts 25, 26 may be reduced, so that the distance between the tread member 21 and the carcass ply 22 may be reduced, too. As alternative additional safety means may be inserted.

The steel cord 10 in accordance with the invention allows a significant reduction of the largest dimension. At the same time, a smooth outer contour 15 of the steel cord 10 is provided. Consequently, the thickness of the coating 18 may be considerably reduced, leading to significant cost savings. Additionally, weight, stiffness and handling of a tyre 20 provided with a steel cord 10 in accordance with the invention may be improved.

The invention claimed is:

1. A steel cord for reinforcing rubber articles, comprising:

a first filament having a first contact surface and a first arcuate shaped outer surface; and a second filament having a second contact surface and a second arcuate shaped outer surface;

wherein the first and second contact surfaces define a gap, having a uniform width, wherein the first and second contact surfaces are disposed adjacent to each other in order to provide the steel cord with a smooth outer contour, and wherein the first and second filaments are embedded in a rubber coating which fills the gap.

2. The steel cord of claim 1, wherein the first and second contact surfaces are flat.

3. The steel cord of claim 1, wherein the first outer surface is semi-circular or semi-elliptical.

4. The steel cord of claim 1, wherein the first outer surface is polygonal.

5. The steel cord of claim 1, wherein the first outer surface includes more than three sides.

6. The steel cord of claim 1, wherein a transition between the first contact surface and the first outer surface includes a radius.

7. The steel cord of claim 1, wherein the first and second contact surfaces are curved.

8. The steel cord of claim 1, wherein the first and second filaments have a same cross-sectional shape.

9. The steel cord of claim 7, wherein the first and second filaments have a same cross-sectional shape.

10. The steel cord of claim 1, wherein the first and second filaments have a different cross-sectional shape.

11. The steel cord of claim 7, wherein the first and second filaments have a different cross-sectional shape.

* * * * *